United States Patent [19]

Colognori

[11] Patent Number: 4,615,066

[45] Date of Patent: Oct. 7, 1986

[54] BACKSCRUBBER AND/OR BACKSCRATCHER WITH REMOVABLE SPONGE ELEMENT

[76] Inventor: Aldo Colognori, 69 Lawton Ave., Cliffside Park, N.J. 07010

[21] Appl. No.: 735,617

[22] Filed: May 20, 1985

[51] Int. Cl.[4] ..... A47L 1/06

[52] U.S. Cl. ..... 15/244 R; 15/145

[58] Field of Search ..... 15/244 R, 145, 244 A

[56] References Cited

U.S. PATENT DOCUMENTS

| | | | |
|---|---|---|---|
| Re. 7,181 | 6/1876 | Kerr | 15/244 R |
| 723,462 | 3/1903 | Hart | 15/244 R |
| 2,637,871 | 5/1953 | Moser | 15/244 R |
| 3,389,418 | 6/1968 | Sencabaugh | 15/244 R |
| 3,570,038 | 3/1971 | Jones | 15/244 R |
| 3,787,919 | 1/1974 | Siemund | 15/244 R |
| 4,571,766 | 2/1986 | Goldman et al. | 15/244 R X |

FOREIGN PATENT DOCUMENTS

| | | | |
|---|---|---|---|
| 1542542 | 9/1968 | France | 15/244 R |

*Primary Examiner*—Chris K. Moore

*Attorney, Agent, or Firm*—Ralph R. Roberts

[57] ABSTRACT

A backscratcher and backscrubber apparatus having a removable and replaceable sponge member is disposed for use with water and the like. This device includes a molded handle member of plastic having a stem portion substantially impervious to water and/or soap used therewith, this handle having an enlarged head portion in which there is provided and formed a through aperture providing a retaining ring-like or rim portion which is integral with a handle portion. The formed aperture is adapted to receive and retain a sponge configurated and sized to be manipulated into a retaining position and condition within the aperture. A first guideway is formed in the rim portion, with this guideway a substantially circular bore whose axis passes substantially through the axis of the aperture and opposite the exit of the guideway is a chamber retaining bore in alignment therewith and providing a second guideway. A sponge-retaining pin of a length greater than the diameter of the through aperture in the head is provided, with this pin having a shank portion. This pin is inserted and passed through the inserted sponge for retaining the sponge within the retaining ring.

10 Claims, 6 Drawing Figures

BACKSCRUBBER AND/OR BACKSCRATCHER WITH REMOVABLE SPONGE ELEMENT

CROSS-REFERENCE TO RELATED U.S. PATENTS

To the extent applicable, this invention pertains to the field of art as my U.S. Pat. No. 4,475,836 which was issued on Oct. 9, 1984 and having the same title.

BACKGROUND OF THE INVENTION

1. Field of the Invention

This invention pertains to backscrubbers or backscratchers and particularly those with removable and replaceable pad elements. This field is directed to a device in which the handle is of molded plastic and has a securing pin that passes through a mounted sponge to secure the sponge in the desired position.

2. Description of the Prior Art

Backscrubbers and backscratchers are well known and first appeared in China with bamboo formations which are still used and sold. Sponges are also well known and for personal scrubbing of pots, pans, hands, feet and the like are a convenient means for using soap in cake or liquid form. Backscrubbers that are known usually have the applicator portions fixedly secured to the handle means to establish a fixed relationship. The present invention provides an inexpensive construction of a backscrubber and/or backscratcher in which the sponge may be made of a rough and firm composition or may be softer for gentle use. The sponge may be of a material that may be used with fluids such as water. The new foamed plastics are of such a material and have many densities and usually are molded to shape. The handle is of molded plastic with a pin providing securing means. Patents of note are PINTEL, U.S. Pat. No. 1,723,520; GRANAT et al, U.S. Pat. No. 2,710,420; COLEMAN, U.S. Pat. No. 2,936,471; HARTMANN, U.S. Pat. No. 3,061,861, and SIEMUND, U.S. Pat. No. 3,787,919.

SUMMARY OF THE INVENTION

This invention pertains to a device for personal use in which both a backscrubber and a backscratcher are present. This device allows personal manipulation to reach portions of the body such as a back and either scratch or apply soap and scrub. In the present illustration of this device, a round sponge pad is depicted with two modes of construction. In one mode, the sponge is shown with a molded center relief providing a positive seating portion for the molded handle. In the other mode, the sponge is shown with a peripheral cut that extends inwardly to about the diameter of the receiving aperture formed in the associated molded handle.

No matter the construction of the sponge as to the outer retaining means, the sponge is sized and is passed through the formed aperture in the handle. It has been found that when the sponge becomes saturated with water, it has a tendency to be dislodged easily. This becomes an annoyance to the user and, to prevent this dislodgement, the present invention provides a pin that passes through the center portion of the sponge to secure this sponge in placed position and condition. The sponge portion may be made in several sizes and thicknesses and degrees of coarseness or stiffness to be used as desired. The handle is easily molded from a plastic material resistant to water and soap. The retaining pin and sponge are likewise of a material unaffected by water and/or soap. The sponge portion may be replaced or repaired without discarding the handle. Two pin retaining means are shown, with one requiring a twist locking motion and the other using a resilient tubular material to provide a friction grip on the shank of the pin.

In addition to the above summary, the following disclosure is detailed to insure adequacy and aid in understanding of the invention. This disclosure, however, is not intended to cover each new inventive concept no matter how it may later be disguised by variations in form or additions of further improvements. For this reason, there have been chosen specific embodiments of the backscrubber and/or backscratcher with removable sponge member as adopted for personal use and showing a preferred means for construction. These specific embodiments have been chosen for the purpose of illustration and description as shown in the accompanying drawing wherein:

BRIEF DESCRIPTION OF THE DRAWINGS

In the following description and in the claims, various details are identified by specific names for convenience. These names are intended to be generic in their application. Corresponding reference characters refer to like members throughout the several figures of the drawing.

DESCRIPTION OF THE EMBODIMENT OF FIGS. 1 THROUGH 3

Figure 1:
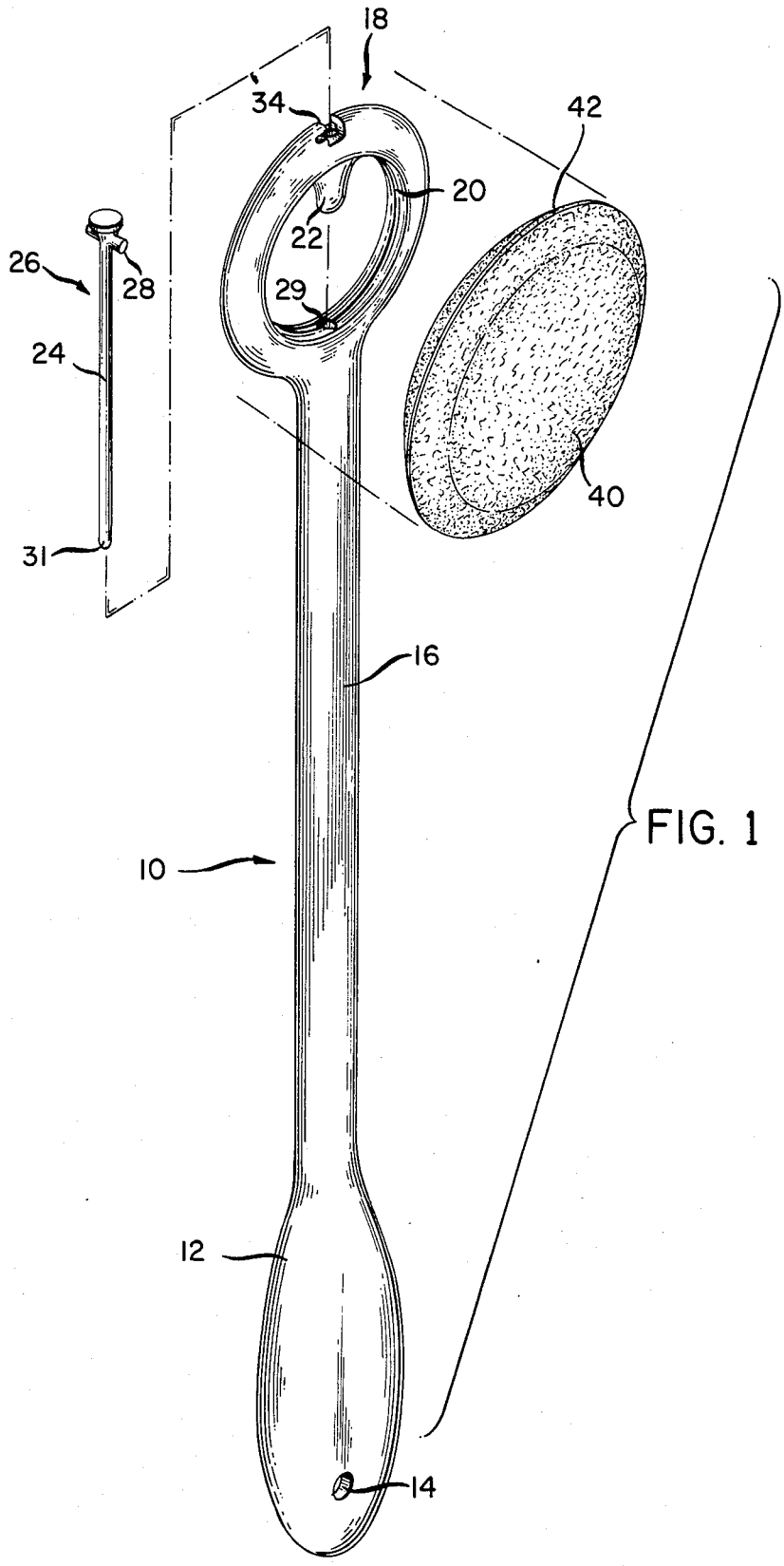
FIG. 1 represents an exploded isometric view of the backscratcher and backscrubber of this invention and showing the relationship of the components.
Figure 2:
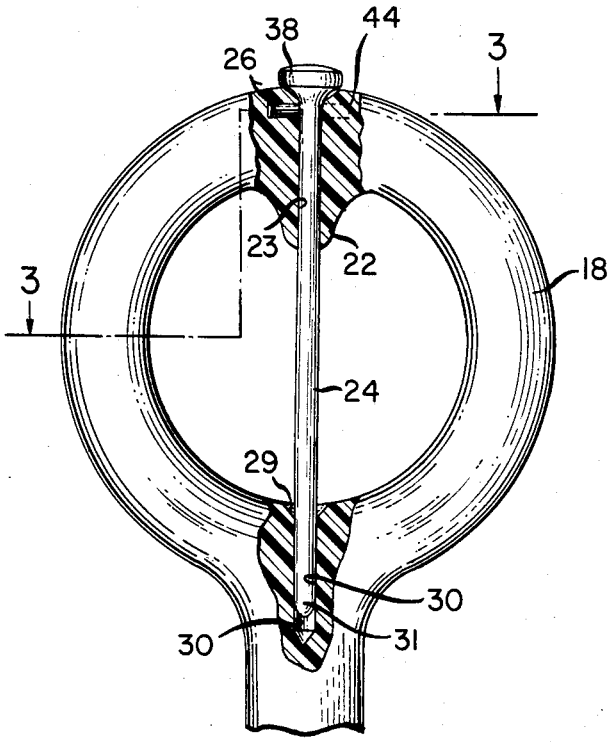
FIG. 2 represents a face or front view in enlarged scale, partly in section, and showing the head end of the handle with a mounted sponge-securing pin.
Figure 6:
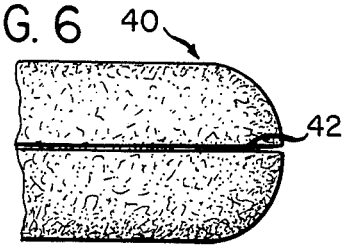
FIG. 6 represents a fragmentary side view of a sponge formed with a peripheral cut to provide a seating means within the formed aperture in the head end of the molded handle.
Figure 3:
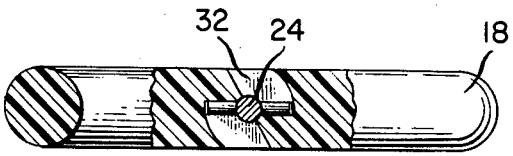
FIG. 3 represents a top view, partly in section, and showing a pin locking concept, this view taken on the line 3—3 of FIG. 2 and looking in the direction of the arrows.

Referring now to the drawings, and in particular to FIGS. 1 through 3, there is shown a handle, generally identified as 10. This handle is contemplated to be of molded plastic which is impervious or very resistant to water and/or soap and soap-like materials which are conventionally used with a bath or shower. This handle has an enlarged distal end 12 shown with a transverse mounting hole 14. This hole is sized and is anticipated to provide hanging of this device on a nail or hook, not shown. This handle includes a shank portion 16 that terminates with a circular head portion, generally identified as 18.

This molded head 18 has a generally circular outer configuration with an interior aperture 20. At the upper end of this aperture is provided a tapered inwardly-extending portion 22 that provides within the head 18 and portion 22 a bore as a slideable guideway and support for a shank or stem portion 24 of a headed pin 26. As depicted in FIGS. 1, 2 and 3, this headed pin has short pin-shaped extension members 28. This aperture 20 has a countersink or bevel 29 and a guide recess 30 sized to receive and retain the entering end 31 of the stem portion 24 of the pin. As particularly seen in FIGS. 2 and 3, the extension members 28 enter cutouts 32 sized and shaped to receive and retain the pin-shaped extension members 28 when and as rotated. The cutouts 32 are formed with a slot 34 which is transverse to the plane of the head 18 of the device. The headed pin is depicted as having a knurled knob 38 which provides grasping and rotating means.

The sponge shown in FIG. 1 is identified as 40 and is shown as having a peripheral cut 42 which is of a depth sufficient to allow the head 18 of the molded member to enter this cut when the sponge 40 has been manipulated and urged into retaining position in aperture 20.

USE AND OPERATION OF EMBODIMENT OF FIGS. 1 THROUGH 3

This backscratcher and backscrubber is contemplated to be used with a shower or bath whereat and wherein the sponge is saturated with water and like fluids. In FIG. 1 is illustrated the assembly of the embodiment. The handle 10 is grasped and the sponge 40 is brought toward and to aperture 20. The cut 42 of this sponge is arranged so as to be brought into manipulation so that the sponge is mounted in this aperture. Manipulation may be required to effect the positioning of this sponge in the aperture. It is to be noted that the stem portion 24 may cause additional manipulation before the desired seating is achieved.

The sponge 40 may be hard or soft, or any grade in between, as desired by the user. Wet sponges are prone to be dislodged with and by vigorous use, particularly when saturated. For this reason, pin 26 is used to maintain this sponge in position. This pin is passed through the central portion of the mounted sponge, with the shank or stem portion 24 securing the sponge. The end 31 of the pin is guided by the bevel 29 into recess 30. After penetration has been achieved, the knurled knob is turned to bring pin-shaped extension members 28 into alignment with slot 34. After bottoming, the pin is turned about a quarter turn to bring the pin and extension portions under retaining portions 44, as seen in FIG. 2. As so secured by the pin, the sponge 40 is retained against unwanted dislocation.

As depicted, the head of the handle is formed with the tapered inwardly-extending portion 22 at the top extent of the head 18 and the tapered entrance 29 and recess 30 are in axial alignment with the bore 23 in the top extent. This positioning does not preclude arranging the pin to be disposed at angles of up to ninety degrees from axial alignment with the axis of the handle.

ALTERNATE EMBODIMENT OF FIG. 4

Figure 4:
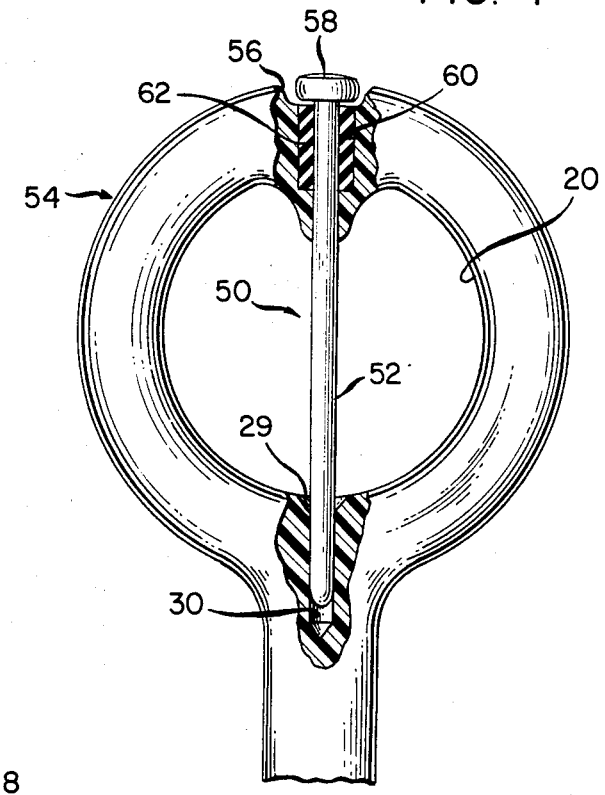
FIG. 4 represents a face or front view in the scale of FIG, 2, this view partly in section, and showing the head end of the molded handle with an alternate pin retaining means.

Rather than the securing arrangement for headed pin 26 as shown in FIGS. 1, 2 and 3, there is depicted in FIG. 4 an alternate securing means in which a headed pin 50 is very like pin 26, but is devoid of pin-shaped extension members 28. This pin, identified as 50, has a shank 52 which enters the countersink 29 and guide recess 30. This head of the handle is identified as 54 and, as depicted, has a small relief 56 providing a means for carrying the head knurled knob 58 so as to reduce the protrusion of the knob 58. A counterbore 60 is formed in this handle head 54 and secured therein is a rubber or resilient tube 62. In a mounted and secured condition, this tube is slightly smaller on its inner bore than the diameter of shank 52. In other respects, the handle head 54 is substantially identical to head 18 described above.

USE AND OPERATION OF EMBODIMENT OF FIG. 4

A sponge 40 is inserted and mounted in the interior aperture 20 with the pin 50 removed. After placing the sponge in the desired position, the pin 50 is inserted through the central portion of the sponge to secure in place. The rubber or resilient tube is sized to tightly grip the shank 52 of the pin 50 to retain the pin in placed condition. The tubular portion 62 acts as a brake against unwanted movement of the pin.

SPONGE CONFIGURATION AS IN FIGS. 5 AND 6

Figure 5:
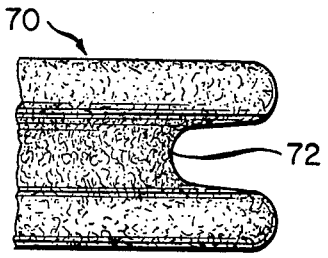
FIG. 5 represents a fragmentary side view of a sponge molded with a retaining groove for the molded head of the handle.

Referring next, and finally, to the depiction in the drawings, there are illustrated two configurations of the sponge. It is contemplated that, in mass production, the sponge element will be molded. In FIG. 5, the sponge is depicted with a molded groove. As shown fragmentarily, the sponge, exemplified as 70, has a central portion formed as a smaller diametrical relief groove 72. This groove is sized so as to provide a seating guide of the sponge 70 within a handle end as in FIG. 2 or FIG. 4. The pin used therewith insures that the mounted sponge remains in place until the pin is withdrawn.

The sponge 40 as seen in FIG. 1 may be molded with a very narrow slot or cut 42. This cut or slot conventionally is made so that the sponge, when mounted within the aperture of the handle, is a tight fit within the interior diameter 20. As the hardness and porosity of the sponge is a varied element and dictated by personal preference, the formation of the sponge and its shape are a matter of selection. The formations exemplified are merely exemplary and not limiting.

Although the head end of the handle is shown with round configuration and encloses an aperture, this head may be molded with other configurations if desired. The aperture 20 depicts the presence of an inwardly-extending portion 22, but this portion 22 may be deleted as long as bore 23 is sufficient to provide a guideway for the shank 24 of the pin 26. The extent of or length of bore 23 is a matter of anticipated use and stress. The molding of the handle and final configuration are a matter of aesthetics and mold construction techniques. The pin is shown as headed for ease of manipulation, but the pin may be void of this head particularly when and where a rubber sleeve is used as a restraining device as in FIG. 4. The pin and shank portion is contemplated to be substantially as depicted, but it is also noted that the pin can be made with a taper configuration in which the entering end may be substantially sharp.

The pin passing through the inserted sponge is utilized to positively retain the sponge until it is desired to remove the sponge whereat the pin is withdrawn for removal and/or replacement of the sponge. The handle and pin are reusable.

As depicted in FIGS. 1, 2 and 3, the pin 26 is shown with two extension members 28. It is, of course, realized that the pin 26 may be made with only one extension member 28 and, rather than pin-shaped, may have another configuration such as a tab. The concept of a twist lock for a pin is not considered novel. However, the concept of utilizing a pin 26 to restrain loss or dislodgement of a sponge is considered novel.

Terms such as "left," "right," "up," "down," "bottom," "top," "front," "back," "in," "out" and the like are applicable to the embodiments shown and described in conjunction with the drawings. These terms are merely for the purposes of description and do not necessarily apply to the position in which the backscrubber or backscratcher may be constructed or used.

While particular embodiments of the backscrubber and/or backscratcher have been shown and described, it is to be understood that the invention is not limited thereto and protection is sought to the broadest extent the prior art allows.

What is claimed is:

1. A backscratcher and backscrubber apparatus having a removable and replaceable sponge member, this apparatus for use with water and the like, said backscratcher and backscrubber apparatus including:

(a) a molded handle member of plastic having a stem portion substantially impervious to water and/or soap used therewith, this handle having an enlarged head portion in which there is provided and formed a through aperture providing a retaining ring-like or rim portion which is integral with a handle portion extending from this rim portion, this aperture adapted to receive and retain a sponge configurated and sized to be manipulated into a retaining position and condition within the aperture;

(b) a first guideway formed in said rim portion, this guideway being a substantially circular bore whose axis passes substantially through the axis of the aperture;

(c) a chamfer and retaining bore diametrically opposite the first guideway and in alignment therewith and providing a second guideway at the opposite side of the aperture;

(d) a sponge-retaining pin of a length greater than the diameter of the through aperture in the head, this pin having a shank portion that is sized to be slideable in the first guideway and in the retaining bore providing the second guideway, and (e) means for retaining said pin in an inserted position when and as the shank of the pin is passed through the inserted sponge and for releasing the pin when it is desired to remove the sponge for repair or replacement.

2. A backscratcher and backscrubber apparatus, as in claim 1, in which the head of the handle is formed with an inwardly-extending portion which is integral therewith and with the rim portion provides a longer support of the extent of said first guideway bore.

3. A backscratcher and backscrubber apparatus, as in claim 2, in which the pin has a head providing manipulating and grasping means and adjacent said head is at least one extension member, and in said rim portion there is an opening to and toward the outer portion of the rim and adjacent said opening there is provided at least one retaining cutout formed in the rim, said extension member and said rim being parts of said retaining means.

4. A backscratcher and backscrubber apparatus, as in claim 3, in which the pin has two diametrically opposed pin-like extension members and there are two like and opposed retaining cutouts formed in said rim portion.

5. A backscratcher and backscrubber apparatus, as in claim 4, in which the sponge-retaining pin is formed with a knurled head.

6. A backscratcher and backscrubber apparatus, as in claim 2, in which the inwardly-extending portion from the rim has a tapered configuration, and the axis of said extending portion and the axis of the first and second guideways are substantially in coincidence with the axis of the stem of the handle.

7. A backscratcher and backscrubber apparatus, as in claim 1, in which the rim portion of the molded handle is made with a counterbore portion in axial alignment with the first guideway, this counterbore being enlarged and open to the outer portion of the rim, and in said counterbore there is mounted and retained a rubber or rubber-like resilient tubular member, which in mounted condition provides an interior bore slightly smaller than said first guideway, producing an interference fit with the shank of the sponge-retaining pin when passed therethrough, said interior bore comprising said detaining means.

8. A backscratcher and backscrubber apparatus, as in claim 7, in which the head of the handle is formed with an inwardly-extending portion which is integral therewith and, with the counterbore so formed extending short of the internal diameter of the aperture.

9. A backscratcher and backscrubber apparatus, as in claim 8, in which the sponge-retaining pin is made with an enlarged head portion adapted for grasping.

10. A backscratcher and backscrubber apparatus, as in claim 9, in which the counterbored entrance is further contoured so as to provide a shallow recess into which the head of the sponge-retaining pin may extend to reduce the protrusion extent.

* * * * *